US006343995B1

(12) United States Patent
Green, Jr. et al.

(10) Patent No.: US 6,343,995 B1
(45) Date of Patent: Feb. 5, 2002

(54) BILLIARD CUE TIP COVER

(76) Inventors: Louis A. Green, Jr., 702 S. Erie St., Bay City, MI (US) 48706; John P. Aguilar, 512 N. Lincoln Suite 111, Bay City, MI (US) 48708

( * ) Notice: Subject to any disclaimer, the term of this patent is extended or adjusted under 35 U.S.C. 154(b) by 0 days.

(21) Appl. No.: 09/648,243

(22) Filed: Aug. 25, 2000

(51) Int. Cl.[7] ..... A63D 15/10
(52) U.S. Cl. ..... 473/43
(58) Field of Search ..... 473/42, 43, 44, 473/46, 49–51

(56) References Cited

U.S. PATENT DOCUMENTS

| | | | | |
|---|---|---|---|---|
| 635,569 A | * | 10/1899 | Miller | 473/43 |
| 2,931,649 A | | 4/1960 | Furda | |
| 4,147,346 A | * | 4/1979 | Giannetti | 473/43 |
| 5,238,457 A | | 8/1993 | Tripplett | |
| 5,351,703 A | | 10/1994 | Moe et al. | |
| 5,725,436 A | | 3/1998 | Miller et al. | |
| 5,785,602 A | | 7/1998 | Morabito | |
| D396,894 S | | 8/1998 | Sanchez | |
| 6,042,481 A | * | 3/2000 | Walker et al. | 473/43 |

FOREIGN PATENT DOCUMENTS

| | | | | |
|---|---|---|---|---|
| GB | 2161393 | * | 1/1986 | 473/42 |

* cited by examiner

*Primary Examiner*—Mark S. Graham

(57) ABSTRACT

A billiard cue tip cover for preventing damage to billiard tables. The billiard cue tip cover includes a main member that has an aperture extending through the main member. The main member is designed for coupling to an end of a billiard cue such that the tip of the billiard cue extends outwardly from the main member. The main member has an outer surface sloping away from the tip of the billiard cue when the main member is coupled to the billiard cue. The outer surface is designed for preventing the tip of the billiard cue from scraping against a playing surface of a billiard table. Thus the main member prevents damage to felt covering the playing surface of the billiard table.

3 Claims, 1 Drawing Sheet

BILLIARD CUE TIP COVER

BACKGROUND OF THE INVENTION

1. Field of the Invention

The present invention relates to billiard cue tip covers and more particularly pertains to a new billiard cue tip cover for preventing damage to a billiard table during use.

2. Description of the Prior Art

The use of billiard cue tip covers is known in the prior art. More specifically, billiard cue tip covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,931,649; U.S. Pat. No. 5,238,457; U.S. Pat. No. 5,785,602; U.S. Pat. No. 5,725,436; U.S. Pat. No. 5,351,703; and U.S. Pat. No. Des. 396,894.

While these devices fulfill their respective, particular objectives and requirements, the aforementioned patents do not disclose a new billiard cue tip cover. The inventive device includes a main member that has an aperture extending through the main member. The main member is designed for coupling to an end of a billiard cue such that the tip of the billiard cue extends outwardly from the main member. The main member has an outer surface sloping away from the tip of the billiard cue when the main member is coupled to the billiard cue. The outer surface is designed for preventing the tip of the billiard cue from scraping against a playing surface of a billiard table. Thus the main member prevents damage to felt covering the playing surface of the billiard table.

In these respects, the billiard cue tip cover according to the present invention substantially departs from the conventional concepts and designs of the prior art, and in so doing provides an apparatus primarily developed for the purpose of preventing damage to billiard tables.

SUMMARY OF THE INVENTION

In view of the foregoing disadvantages inherent in the known types of billiard cue tip covers now present in the prior art, the present invention provides a new billiard cue tip cover construction wherein the same can be utilized for preventing damage to billiard tables.

The general purpose of the present invention, which will be described subsequently in greater detail, is to provide a new billiard cue tip cover apparatus and method which has many of the advantages of the billiard cue tip covers mentioned heretofore and many novel features that result in a new billiard cue tip cover which is not anticipated, rendered obvious, suggested, or even implied by any of the prior art billiard cue tip covers, either alone or in any combination thereof.

To attain this, the present invention generally comprises a main member that has an aperture extending through the main member. The main member is designed for coupling to an end of a billiard cue such that the tip of the billiard cue extends outwardly from the main member. The main member has an outer surface sloping away from the tip of the billiard cue when the main member is coupled to the billiard cue. The outer surface is designed for preventing the tip of the billiard cue from scraping against a playing surface of a billiard table. Thus the main member prevents damage to felt covering the playing surface of the billiard table.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new billiard cue tip cover apparatus and method which has many of the advantages of the billiard cue tip covers mentioned heretofore and many novel features that result in a new billiard cue tip cover which is not anticipated, rendered obvious, suggested, or even implied by any of the prior art billiard cue tip covers, either alone or in any combination thereof.

It is another object of the present invention to provide a new billiard cue tip cover which may be easily and efficiently manufactured and marketed.

It is a further object of the present invention to provide a new billiard cue tip cover which is of a durable and reliable construction.

An even further object of the present invention is to provide a new billiard cue tip cover which is susceptible of a low cost of manufacture with regard to both materials and labor, and which accordingly is then susceptible of low prices of sale to the consuming public, thereby making such billiard cue tip cover economically available to the buying public.

Still yet another object of the present invention is to provide a new billiard cue tip cover which provides in the apparatuses and methods of the prior art some of the advantages thereof, while simultaneously overcoming some of the disadvantages normally associated therewith.

Still another object of the present invention is to provide a new billiard cue tip cover for preventing damage to billiard tables.

Yet another object of the present invention is to provide a new billiard cue tip cover which includes a main member that has an aperture extending through the main member. The main member is designed for coupling to an end of a billiard cue such that the tip of the billiard cue extends outwardly from the main member. The main member has an outer surface sloping away from the tip of the billiard cue when the main member is coupled to the billiard cue. The outer surface is designed for preventing the tip of the billiard cue from scraping against a playing surface of a billiard table. Thus the main member prevents damage to felt covering the playing surface of the billiard table.

Still yet another object of the present invention is to provide a new billiard cue tip cover that aids in the teaching of how to properly play pool without contacting the felt of a billiard table with the tip of the billiard cue.

Even still another object of the present invention is to provide a new billiard cue tip cover that provides greater accuracy when hitting a ball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
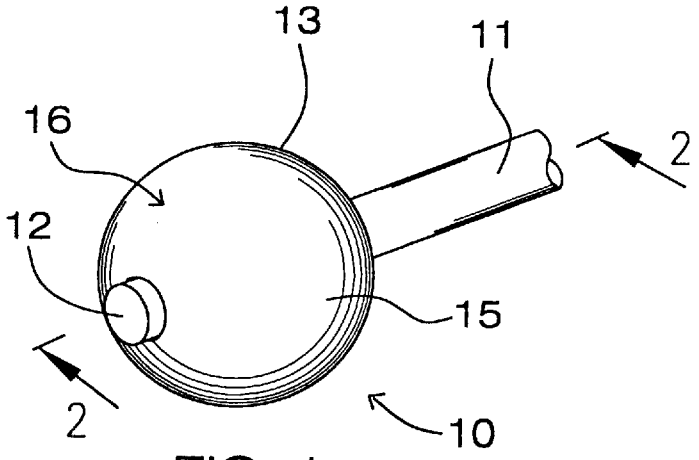
FIG. 1 is a perspective view of a new billiard cue tip cover according to the present invention.
Figure 2:
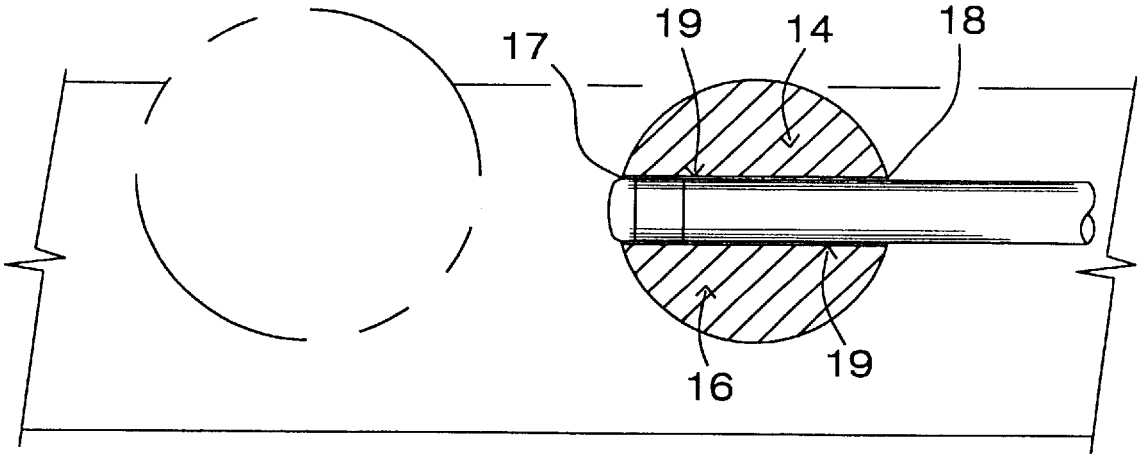
FIG. 2 is a cross section view of the present invention.

With reference now to the drawings, and in particular to FIGS. 1 through 2 thereof, a new billiard cue tip cover embodying the principles and concepts of the present invention and generally designated by the reference numeral 10 will be described.

As best illustrated in FIGS. 1 through 2, the billiard cue tip cover 10 generally comprises of a billiard cue 11, which has a tip 12.

The main member 13 is generally spherical and has an aperture 14 that extends through the main member 13 such that the main member 13 can receive a billiard cue 11. The tip 12 of the billiard cue 11 extends outwardly from the main member 13. The tip 12 of the billiard cue 11 is designed for inserting into a depression in a piece of chalk for applying chalk to the tip 12 of the billiard cue 11 when the main member 13 is engaged to the billiard cue 11.

The main member 13 has an outer surface 15 that slops away from the tip 12 of the billiard cue 11 when the main member 13 is coupled to the billiard cue 11. The outer surface 15 is for preventing the tip 12 of the billiard cue 11 from scraping against a playing surface of a billiard table. The main member 13 prevents damage to felt covering the playing surface of the billiard table.

In alternate embodiments, the main member 13 is constructed from a material 16 chosen from the group of materials consisting of rubber and plastic.

The aperture 14 has a first end 17, a second end 18, and an interior wall 19 that extends between the first end 17 and the second end 18.

The first end 17 has a radius smaller than the radius of the second end 18. The interior wall 19 tapers between the second end 18 and the first end 17 such that the interior wall 19 frictionally engages an outer surface of the billiard cue. The main member 13 is coupled to the billiard cue 11 when the billiard cue 11 is fully inserted into the aperture 14.

In use, place the cue stick tip 12 through the second end 18 of the main member 13 with the tip 12 of the cue sticking out the first end 17 of the main member 13.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A billiard cue end protective device comprising:

a main member having an aperture extending through said main member such that said main member is adapted for coupling to an end of a billiard cue such that a tip of the billiard cue extends outwardly from said main member;

said main member having an outer surface sloping away from the tip of the billiard cue when the main member is coupled to the billiard cue whereby said outer surface is adapted for preventing the tip of the billiard cue from scraping against a playing surface of a billiard table whereby said main member prevents damage to felt covering the playing surface of the billiard table;

said main member being generally spherical;

said main member being constructed from a material chosen from the group of materials consisting of rubber and plastic;

said aperture having a first end, a second end, and an aperture wall extending between said first end and said second end; and said first end having a radius smaller than a radius of said second end, said aperture wall tapering between said second end and said first end such that said aperture wall is adapted for frictionally engaging an outer surface of the billiard cue whereby said main member is coupled to the billiard cue when the billiard cue is fully inserted into said aperture.

2. A billiard cue end protective system comprising:

a billiard cue having a tip;

a generally spherical main member having an aperture extending through said main member such that said main member for receiving said billiard cue such that said tip of said billiard cue extends outwardly from said main member whereby said tip of said billiard cue is adapted for inserting into a depression in a piece of chalk for applying chalk to said tip of said billiard cue when said main member is engaged to said billiard cue;

said main member having an outer surface sloping away from the tip of the billiard cue when the main member is coupled to the billiard cue whereby said outer surface is adapted for preventing the tip of the billiard cue from scraping against a playing surface of a billiard table whereby said main member prevents damage to felt covering the playing surface of the billiard table;

said main member being constructed from a material chosen from the group of materials consisting of rubber and plastic;

said aperture having a first end, a second end, and an aperture wall extending between said first end and said second end; and said first end having a radius smaller than a radius of said second end, said aperture wall tapering between said second end and said first end such that said aperture wall frictionally engages an outer surface of said billiard cue whereby said main member is coupled to said billiard cue when said billiard cue is fully inserted into said aperture.

3. A billiard cue end protective device comprising:

a main member having an aperture extending through said main member such that said main member is adapted for coupling to an end of a billiard cue such that a tip of the billiard cue extends outwardly from said main member;

said main member having an outer surface sloping away from the tip of the billiard cue when the main member is coupled to the billiard cue whereby said outer surface is adapted for preventing the tip of the billiard cue from scraping against a playing surface of a billiard table whereby said main member prevents damage to felt covering the playing surface of the billiard table;

said main member being generally spherical;

said aperture having a first end, a second end, and an aperture wall extending between said first end and said second end; and said first end having a radius smaller than a radius of said second end, said aperture wall tapering between said second end and said first end such that said aperture wall is adapted for frictionally engaging an outer surface of the billiard cue whereby said main member is coupled to the billiard cue when the billiard cue is fully inserted into said aperture.

* * * * *